US011002515B2

(12) United States Patent
Won et al.

(10) Patent No.: US 11,002,515 B2
(45) Date of Patent: May 11, 2021

(54) INTELLIGENT ARTILLERY FIRE SUPPORTING DEVICE AND OPERATION METHOD THEREOF

(71) Applicant: NAVIWORKS CO., LTD., Anyang-si (KR)

(72) Inventors: Jun Hee Won, Seoul (KR); Gu Han Kim, Chungcheongbuk-do (KR); Jae Eon Lee, Anyang-si (KR)

(73) Assignee: NAVIWORKS CO., LTD., Anyang-si (KR)

( * ) Notice: Subject to any disclaimer, the term of this patent is extended or adjusted under 35 U.S.C. 154(b) by 261 days.

(21) Appl. No.: 16/305,183

(22) PCT Filed: Nov. 24, 2017

(86) PCT No.: PCT/KR2017/013495
§ 371 (c)(1),
(2) Date: Nov. 28, 2018

(87) PCT Pub. No.: WO2018/131791
PCT Pub. Date: Jul. 19, 2018

(65) Prior Publication Data

US 2020/0378722 A1 Dec. 3, 2020

(30) Foreign Application Priority Data

Jan. 16, 2017 (KR) ..... 10-2017-0007046

(51) Int. Cl.
*F41G 3/14* (2006.01)
*F41G 3/04* (2006.01)
*F41G 3/28* (2006.01)

(52) U.S. Cl.
CPC ..... *F41G 3/142* (2013.01); *F41G 3/04* (2013.01); *F41G 3/28* (2013.01)

(58) Field of Classification Search
CPC ... F41G 3/14; F41G 3/142; F41G 3/04; G09B 9/003
See application file for complete search history.

(56) References Cited

U.S. PATENT DOCUMENTS 4,004,487 A * 1/1977 Eichweber ..... F41A 23/34 89/1.815
6,281,841 B1 * 8/2001 Nevill ..... F41G 3/04 342/357.59

(Continued)

FOREIGN PATENT DOCUMENTS

JP 6145530 B2 * 6/2017 ..... F41G 3/165
KR 1020090045760 A 5/2009

(Continued)

OTHER PUBLICATIONS

Wilms, E.V., "Ballistic Equations for Artillery Shells", AD 282305, Armed Services Technical Information Agency (Year: 1962).*

(Continued)

*Primary Examiner* — Joshua T Semick
(74) *Attorney, Agent, or Firm* — Hauptman Ham, LLP

(57) ABSTRACT

Disclosed are an intelligent artillery supporting apparatus and a method of operating the same which can support a movement of a scheduled fire point of impact for each artillery weapon displayed as a result of a scheduled fire simulation for a target area to a new point of impact which an operator desires and automatically calculate and provide new firing data according to the movement of the scheduled fire point of impact, thereby effectively supporting artillery tactics.

11 Claims, 8 Drawing Sheets

(56) References Cited

U.S. PATENT DOCUMENTS

| | | | | |
|---|---|---|---|---|
| 6,875,019 | B2 * | 4/2005 | Huang | F41G 3/2694 434/11 |
| 7,275,691 | B1 * | 10/2007 | Wright | F41G 3/04 235/404 |
| 8,046,203 | B2 * | 10/2011 | Blevins | F41G 3/32 703/6 |
| 8,794,119 | B2 * | 8/2014 | Shulman | F41G 3/04 89/41.06 |
| 9,816,785 | B2 * | 11/2017 | McNeil | F41G 3/165 |
| 2018/0061037 | A1 * | 3/2018 | Guthrie | F41G 3/06 |

FOREIGN PATENT DOCUMENTS

| | | | |
|---|---|---|---|
| KR | 101119882 | B1 | 2/2012 |
| KR | 1020140061940 | A | 5/2014 |
| KR | 1020150118360 | A | 10/2015 |
| KR | 1020160015143 | A | 2/2016 |

OTHER PUBLICATIONS

Lieske et al., "Modified Point Mass Trajectory Simulation for Base-Burn Projectiles", AD-A248292, U.S. Army Labratory Command (Year: 1992).*

International Search Report dated Feb. 27, 2018, corresponding to International Application No. PCT/KR2017/013495 citing the above reference(s).

* cited by examiner

<scheduled fire points of impact>

<scheduled fire points of impact>

<new points of impact>

INTELLIGENT ARTILLERY FIRE SUPPORTING DEVICE AND OPERATION METHOD THEREOF

CROSS REFERENCE TO RELATED APPLICATION

This present application is a national stage filing under 35 U.S.C § 371 of PCT application number PCT/KR2017/013495 filed on Nov. 24, 2017 which is based upon and claims the benefit of priority to Korean Patent Application No. 10-2017-0007046 filed on Jan. 16, 2017 in the Korean Intellectual Property Office. The disclosures of the above-listed applications are hereby incorporated by reference herein in their entirety.

BACKGROUND OF THE INVENTION

1. Field of the Invention

The present disclosure relates to a method of supporting a movement of a scheduled fire point of impact for each artillery weapon displayed as a result of a scheduled fire simulation for a target area to a new point of impact which an operator desires and automatically calculating and providing new firing data (an angle of deviation and a shooting range) according to the movement of the scheduled fire point of impact.

2. Description of the Prior Art

A firing of an artillery weapon may be implemented through a method of indirect firing from a long distance at which a target cannot be directly seen but the farther a shooting distance is, a point of impact becomes a wider area according to a probable error, so that it is very difficult to achieve a firing effect.

Further, despite the fact that a target subject to the artillery fire is a large scale area target and various attack technologies are required according to a geographical factor and a characteristic, a size, and a shape of the target, there is no firing technology to effectively solve the problem at present.

Accordingly, there is a need to prepare a firing control technology that supports a delivery of a shell to the target area considering the size and the shape of the target and the geographical factors using the most effective method to achieve the firing effect by the operator.

SUMMARY OF THE INVENTION

The present disclosure has been made to solve the above problem and an objective of the present disclosure is to support a movement of a scheduled fire point of impact for each artillery weapon displayed as a result of a scheduled fire simulation for a target area to a new point of impact which an operator desires and to automatically calculate and provide new firing data according to the movement of the scheduled fire point of impact.

An apparatus for supporting an artillery fire according to an embodiment of the present disclosure to achieve the objective includes: a display configured to display a scheduled fire point of impact for each artillery weapon corresponding to a result of a scheduled fire simulation of each of a plurality of artillery weapons located in artillery positions implemented for a target area as an impact type image based on a probable error probability; an identifier configured to identify, when a scheduled fire point of impact of a particular artillery weapon among the plurality of artillery weapons moves to a new point of impact by an operator's control, latitude/longitude coordinates of the artillery positions and latitude/longitude coordinates of the new point of impact; and a calculator configured to calculate new firing data for placing the point of impact of the particular artillery weapon on the new point of impact according to a calculation equation based on an Earth coordinate system defined by a location relation between the latitude/longitude coordinates of the artillery positions and the latitude/longitude coordinates of the new point of impact.

More specifically, the location relation between the latitude/longitude coordinates of the artillery positions and the latitude/longitude coordinates of the new point of impact may include at least one of a location relation in which a difference between the latitude coordinate of the artillery positions and the latitude coordinate of the new point of impact is smaller than a threshold value, a location relation in which a difference between the longitude coordinate of the artillery positions and the longitude coordinate of the new point of impact is smaller than a threshold value, and a location relation in which both the difference between the latitude coordinate of the artillery positions and the latitude coordinate of the new point of impact and the difference between the longitude coordinate of the artillery positions and the longitude coordinate of the new point of impact are larger than the threshold values.

More specifically, the apparatus for supporting the artillery fire may further include a processor configured to process a deviation value between initial firing data applied to implement a scheduled firing to the scheduled fire point of impact by the particular artillery weapon and the new firing data to be displayed.

More specifically, the apparatus for supporting the artillery fire may further include a deducer configured to deduce a firing effect having a numerical value based on a distribution of the impact type images of points of impact for respective artillery weapons including the new point of impact.

More specifically, the distribution of the impact type images may be determined based on at least one of a size of an area occupied by the impact type images within the target area and a size of an overlapping area between the impact type images, and, as at least one of the size of the area occupied by the impact type images within the target area and the size of the overlapping area between the impact type images increases, the firing effect having a higher numerical value may be deduced.

A method of operating an artillery fire supporting apparatus according to an embodiment of the present disclosure to achieve the objective includes: a display step of displaying a scheduled fire point of impact for each artillery weapon corresponding to a result of a scheduled fire simulation of each of a plurality of artillery weapons located in artillery positions implemented for a target area as an impact type image based on a probable error probability; an identification step of identifying, when a scheduled fire point of impact of a particular artillery weapon among the plurality of artillery weapons moves to a new point of impact by an operator's control, latitude/longitude coordinates of the artillery positions and latitude/longitude coordinates of the new point of impact; and a calculation step of calculating new firing data for placing the point of impact of the particular artillery weapon on the new point of impact according to a calculation equation based on an Earth coordinate system defined by a location relation between the latitude/longitude coordinates of the artillery positions and the latitude/longitude coordinates of the new point of impact.

More specifically, the location relation between the latitude/longitude coordinates of the artillery positions and the latitude/longitude coordinates of the new point of impact may include at least one of a location relation in which a difference between the latitude coordinate of the artillery positions and the latitude coordinate of the new point of impact is smaller than a threshold value, a location relation in which a difference between the longitude coordinate of the artillery positions and the longitude coordinate of the new point of impact is smaller than a threshold value, and a location relation in which both the difference between the latitude coordinate of the artillery positions and the latitude coordinate of the new point of impact and the difference between the longitude coordinate of the artillery positions and the longitude coordinate of the new point of impact are larger than the threshold values.

More specifically, the method may further include a processing step of processing a deviation value between initial firing data applied to implement a scheduled firing to the scheduled fire point of impact by the particular artillery weapon and the new firing data to be to displayed.

More specifically, the method may further include a deducing step of deducing a firing effect having a numerical value based on a distribution of the impact type images of points of impact for respective artillery weapons including the new point of impact.

More specifically, the distribution of the impact type images may be determined based on at least one of a size of an area occupied by the impact type images within the target area and a size of an overlapping area between the impact type images, and, as at least one of the size of the area occupied by the impact type images within the target area and the size of the overlapping area between the impact type images increases, the firing effect having a higher numerical value may be deduced.

Another embodiment of the present disclosure may provide a computer program implemented to execute each step of the method of operating the artillery fire supporting apparatus and stored in a computer-readable recording medium.

Another embodiment of the present disclosure may provide a computer-readable recording medium including instructions to execute each step of the method of operating the artillery fire supporting apparatus.

Accordingly, an intelligent artillery supporting apparatus and a method of operating the same according to the present disclosure can support a movement of a scheduled fire point of impact for each artillery weapon displayed as a result of a scheduled fire simulation for a target area to a new point of impact which an operator desires and automatically calculate and provide new firing data according to the movement of the scheduled fire point of impact, thereby effectively supporting artillery tactics.

BRIEF DESCRIPTION OF THE DRAWINGS

The above and other objects, features and advantages of the present disclosure will be more apparent from the following detailed description taken in conjunction with the accompanying drawings, in which.

DETAILED DESCRIPTION OF THE EXEMPLARY EMBODIMENTS

Hereinafter, an embodiment of the present disclosure will be described with reference to the accompanying drawings.

Figure 1:
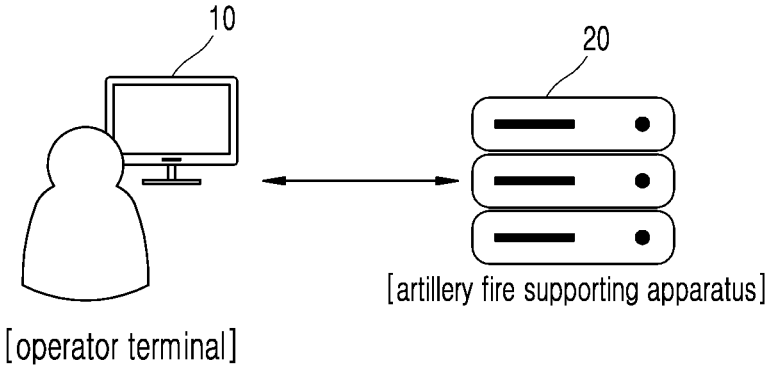
FIG. 1 illustrates an artillery fire supporting environment according to an embodiment of the present disclosure.

FIG. 1 illustrates an artillery fire supporting environment according to an embodiment of the present disclosure.

As illustrated in FIG. 1, the artillery fire supporting environment according to the embodiment of the present disclosure includes an operator terminal 10 and an artillery fire supporting apparatus 20 that supports a fire control by an operator through a link with the operator terminal 10.

The operator terminal 10 refers to a terminal controlled by the operator through a UI (User Interface) provided from the artillery fire supporting apparatus 20.

The operator terminal 10 may correspond to, for example, a PC, a notebook, a smart pad, or a tablet PC, but is not limited thereto and may also include all devices that support an interface through a UI screen.

The artillery fire supporting apparatus 20 refers to a device that implements a simulation based on a Geographic Information System (GIS) and provides a UI screen according to the simulation so as to support a fire control by the operator.

The artillery fire supporting apparatus 20 may be, for example, a server which the operator terminal 10 can access through a wired/wireless communication network or have a form of a software module (for example, an application) installed in the operator terminal 10.

In the artillery fire supporting environment according to the embodiment of the present disclosure, the fire control may be supported in artillery tactics based on the aforementioned elements and, hereinafter, elements within the artillery fire supporting apparatus 20 for implementing the supporting of the artillery control will be described in more detail.

Figure 2:
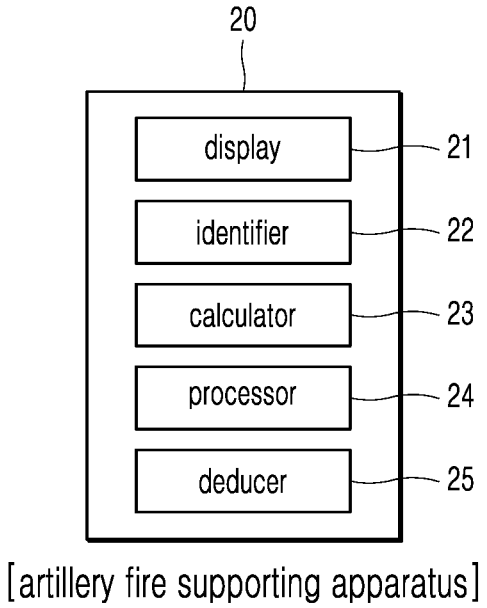
FIG. 2 is a schematic block diagram illustrating an artillery fire supporting apparatus according to an embodiment of the present disclosure.

FIG. 2 schematically illustrates a configuration of the artillery fire supporting apparatus 20 according to an embodiment of the present disclosure.

As illustrated in FIG. 2, the artillery fire supporting apparatus 20 according to the embodiment of the present disclosure may include a display 21 for displaying a point of impact of each artillery weapon, an identifier 22 for identifying latitude/longitude coordinates, and a calculator 23 for calculating firing data.

Further, in addition to the aforementioned elements, the artillery fire supporting apparatus 20 according to the embodiment of the present disclosure may further include a processor 24 for processing and displaying a deviation value between firing data and a deducer 25 for deducing a firing effect.

As a result, the artillery fire supporting apparatus 20 according to the embodiment of the present disclosure may support a fire control for a plurality of artillery weapons located in artillery positions through the aforementioned elements and, hereinafter, each element within the artillery fire supporting apparatus 20 for implementing the supporting of the artillery fire will be described in detail.

The display 21 performs a function of displaying a point of impact of each of the artillery weapons.

More specifically, when each of the plurality of artillery weapons located in the artillery positions implements a scheduled fire simulation for a target area according to initial firing data (an angle of deviation and a shooting range), the display 21 displays the point of impact of each of the artillery weapons (hereinafter, referred to as a "scheduled fire point of impact) corresponding to a result of the scheduled fire simulation on a UI screen.

Figure 3:
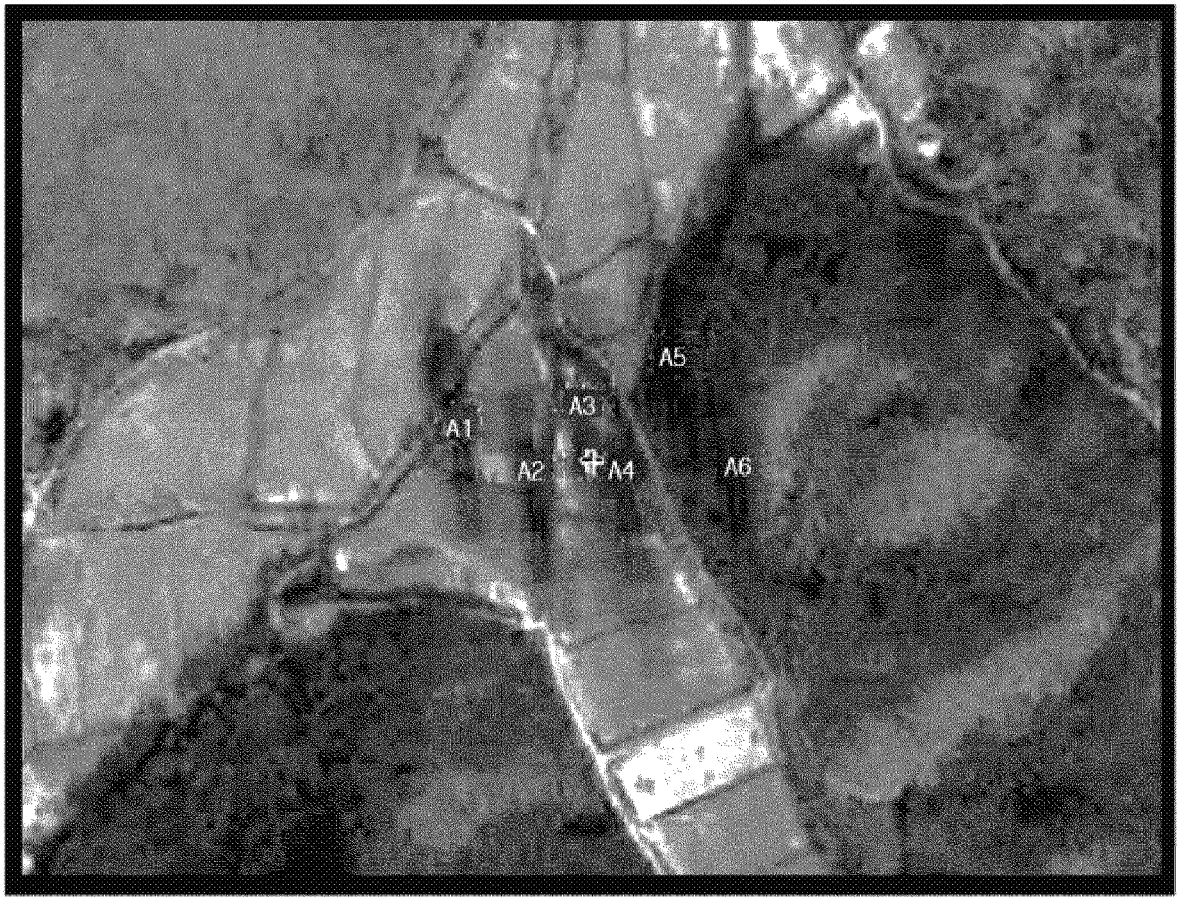
FIG. 3 illustrates a UI screen for describing scheduled fire points of impact according to an embodiment of the present disclosure.

At this time, the display 21 displays the scheduled fire points of impact of respective artillery weapons to be distinguished from each other, and the distinguished scheduled fire points of impact of respective artillery weapons are displayed in the form of impact type images A1, A2, A3, A4, A5, and A6 based on a probable error probability as illustrated in FIG. 3.

Figure 4:
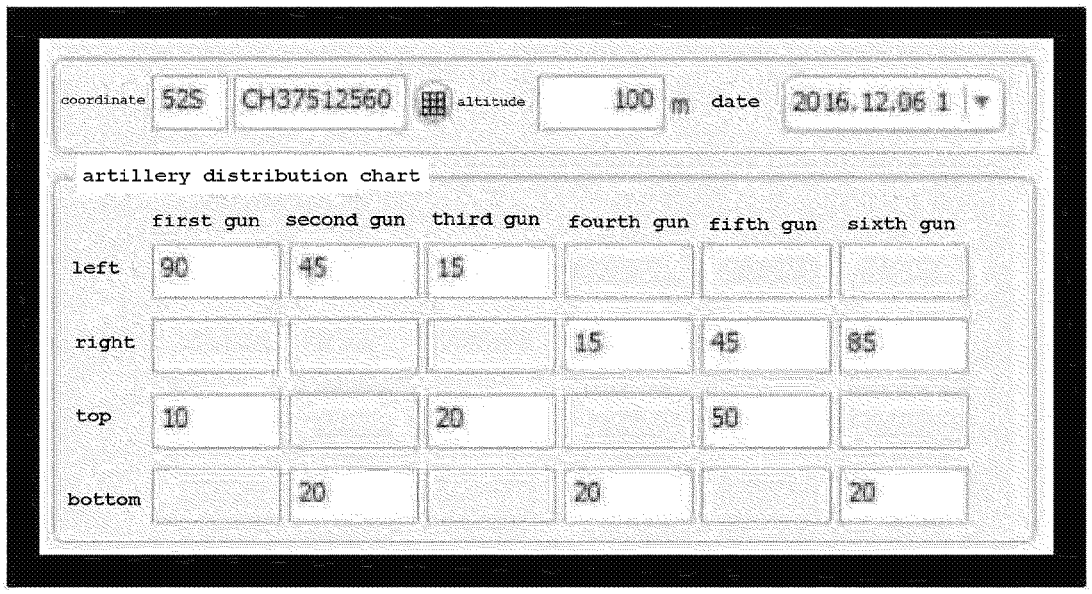
FIG. 4 illustrates a UI screen for describing an artillery distribution chart according to an embodiment of the present disclosure.

Here, each of the impact type images A1, A2, A3, A4, A5, and A6 corresponds to an impact type image of each of a first gun to a sixth gun at a scheduled fire point of impact based on the probable error probability on an artillery distribution chart UI screen according to an embodiment of the present disclosure of FIG. 4.

For reference, a numerical value of each of the left, the right, the top, and the bottom of each artillery weapon (first gun to sixth gun) is shown on the artillery distribution chart UI screen according to the embodiment of the present disclosure illustrated in FIG. 4. The numerical value refers to a location of each artillery weapon separated from a central location corresponding to a coordinate (52S CH37512560) and an altitude (100 m) within the same UI screen, and the separation unit may be interpreted as a meter (m).

The identifier 22 performs a function of identifying latitude/longitude coordinates.

More specifically, when scheduled fire points of impact of some of the plurality of artillery weapons move to new points of impact (hereinafter, referral to as "new points of impact) by an operator's control according to the application of special sheaf for a target area, the identifier 22 identifies latitude/longitude coordinates of the artillery positions where the plurality of artillery weapons are located and latitude/longitude coordinates of the new points of impact.

Here, the movement from the scheduled fire points of impact to the new points of impact may be made through, for example, a touch control or drag and drop using a control unit such as a mouse in the operator terminal 10 that displays the UI screen.

Figure 5:
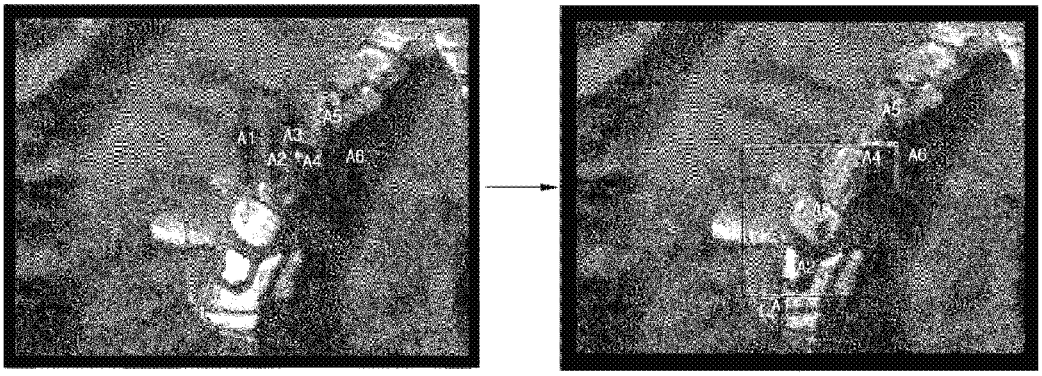
FIG. 5 illustrates a UI screen for describing new points of impact according to an embodiment of the present disclosure.

For reference, FIG. 5 shows a state where, among the scheduled fire points of impact of the plurality of artillery weapons, scheduled fire points of impact A1, A2, and A3 of a first gun, a second gun, and a third gun have moved to new points of impact.

Meanwhile, a distribution of the new points of impact (impact type image) may be calculated as equation (1) below.

New point of impact distribution $x$=scheduled fire point of impact distribution $x$+[cos(angle(α,β))×angle(α,β)]

New point of impact distribution $y$=scheduled fire point of impact distribution $y$+[cos(angle(α,β))×angle(α,β)]

<α=latitude/longitude coordinates of scheduled fire point of impact, β=latitude/longitude coordinates of new point of impact> equation (1)

Here, the angle (α,β) may be understood as an angle of an extension line connecting α and β with respect to due north in a clockwise direction in a coordinate system of north, south, east, and west based on a, and the new point of impact x and new point of impact y denote an x axis distance and a Y axis distance of the impact type image of each new point of impact.

The calculator 23 performs a function of calculating new firing data on the new point of impact.

More specifically, when the latitude/longitude coordinate of the artillery positions and the latitude/longitude coordinate of the new point of impact are identified, the calculator 23 calculates new firing data (an angle of deviation and a shooting range) on the new point of impact by using a calculation equation based on an Earth coordinate system defined according to a location relation between the latitude/longitude coordinate of the artillery positions and the latitude/longitude coordinate of the new point of impact.

Here, the location relation between the latitude/longitude coordinate of the artillery positions and the latitude/longitude coordinate of the new point of impact may include a location relation in which a difference between the latitude coordinate of the artillery positions and the latitude coordinate of the new point of impact is smaller than a threshold value, a location relation in which a difference between the longitude coordinate of the artillery positions and the longitude coordinate of the new point of impact is smaller than a threshold value, and a location relation in which both the difference between the latitude coordinate of the artillery positions and the latitude coordinate of the new point of impact and the difference between the longitude coordinate of the artillery positions and the longitude coordinate of the new point of impact are larger than the threshold values.

Hereinafter, the calculation equation defined according to each location relation and a calculation result of new firing data (an angle of deviation and a shooting range) calculated through the calculation equation will be described.

Meanwhile, the calculation equation defined according to each location relation is based upon the premise of the following matters.

$WGS84FF$ (flatness ratio)=0.0033528106647475

$WGS84FFEQ$ (flatness ratio equation)=$\sqrt{(2\times WGS84FF)-(WGS84FF\times WGS84FF)}$ RADIUSG (Earth radius)=6378137

Π (circular constant)=3.141592

RADIUSGPI (Earth radius θ)=RADIUSG×Π/180 a=latitude coordinate of artillery positions b=longitude coordinate of artillery positions c=latitude coordinate of new point of impact d=longitude coordinate of new point of impact e=angle of deviation of scheduled fire point of impact f=shooting range of scheduled fire point of impact First, in the location relation in which the difference between the latitude coordinate of the artillery positions and the latitude coordinate of the new point of impact is smaller than the threshold value (|c−a|<0.000005), the new firing data (the angle of deviation and the shooting range of the new point of impact) may be calculated based on equation (2) below.

$$\alpha = WGS84FFEQ \times \sin(c) \qquad \text{equation (2)}$$

Shooting range 1 =

$$RADIUSGPI \times (d-b) \times \frac{\cos(c)}{\sqrt{1-(a \times a)}}$$

Ange of deviation 1 = 90° when $(d-b) > 0$ and, otherwise, 270°

Next, in the location relation in which the difference between the longitude coordinate of the artillery positions and the longitude coordinate of the new point of impact is smaller than the threshold value (|d−b|<0.000005), the new firing data (the angle of deviation and the shooting range of the new point of impact) may be calculated based on equation (3) below.

β=distance (*c*) from equator−distance (*a*) from equator Shooting range 2=|β|Angle of deviation 2=0° when (*c*−*a*)>0 and, otherwise, 180° equation (3)

Here, the distance (c) from the equator denotes a distance between the equator (a location of latitude 0°) and the latitude coordinate of the new point of impact, and the distance (d) from the equator denotes a distance between the equator and the latitude coordinate of the artillery positions.

Lastly, in the location relation in which both the difference between the latitude coordinate of the artillery positions and the latitude coordinate of the new point of impact and the difference between the longitude coordinate of the artillery positions and the longitude coordinate of the new point of impact are larger than the threshold values, the new firing data (the angle of deviation and the shooting range of the new point of impact) may be calculated based on equation (4) below.

*y*=distance (*c*) from equator−distance (*a*) from equator Angle of deviation 3=a tan((*d*−*b*),γ) Shooting range 3=β/cos (angle of deviation 3) equation (4)

Figure 6A:
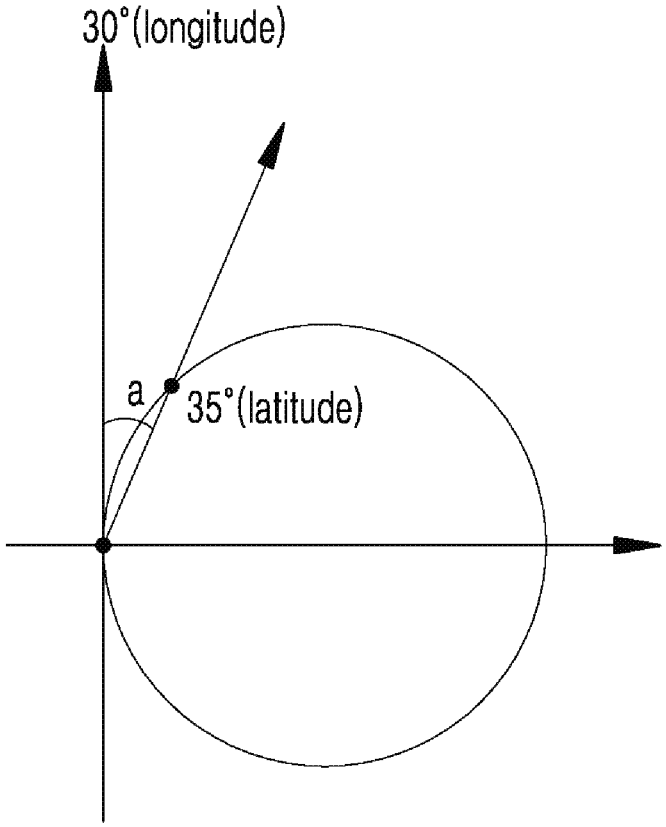
FIG. 6 illustrates an angle with respect to the equator according to an embodiment of the present disclosure.
Figure 6B:
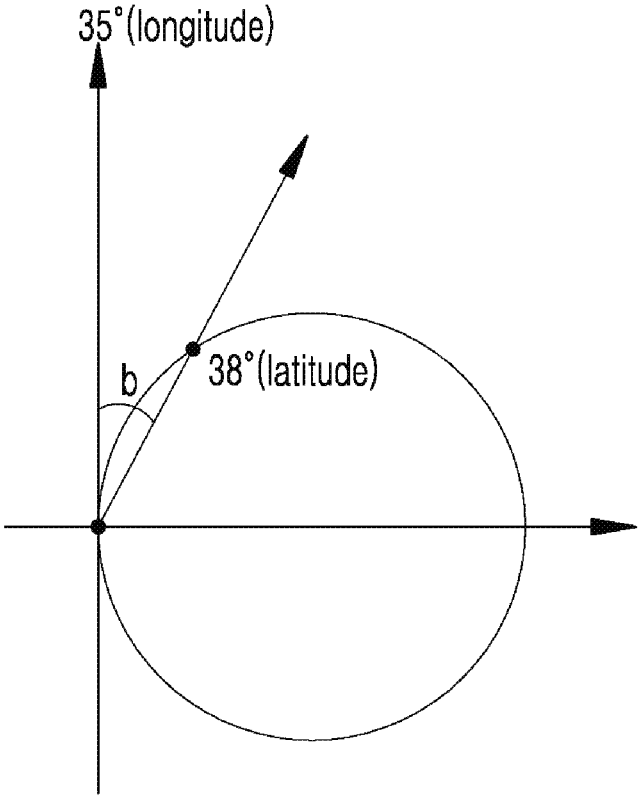

Here, the angle (c) from the equator denotes an angle (a) between an Y axis and an extension line from an intersection between the longitude coordinate (for example, 30°) of the artillery positions and the equator (latitude 0°) to the latitude coordinate (for example, 35°) of the artillery positions as illustrated in FIG. 6A, and the angle (c) from the equator denotes an angle between the Y axis and an extension line from an intersection between the longitude coordinate (for example, 35°) of the new point of impact and the equator (latitude) 0° to the latitude coordinate (for example, 38°) of the new point of impact as illustrated in FIG. 6B.

The processor 23 performs a function of processing to display a deviation value between firing data.

More specifically, when the calculation for the new firing data is completed, the processor 23 processes to display a firing data deviation value corresponding to a difference between the initial firing data (the angle of deviation and the shooting range) and the new firing data (the angle of deviation and the shooting range) applied to implement the scheduled firing to the scheduled fire point of impact on the UI screen.

Figure 7:
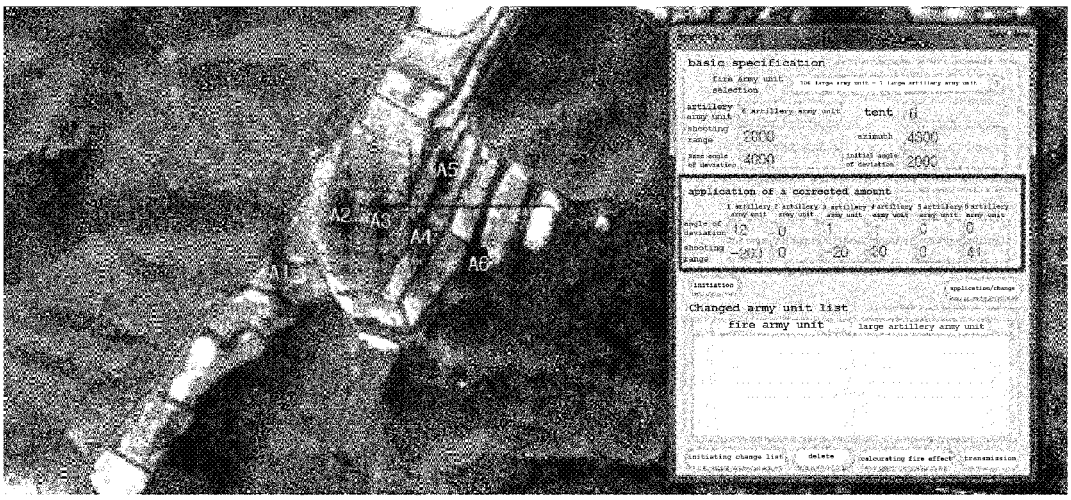
FIG. 7 illustrates a UI screen for describing a firing data deviation value according to an embodiment of the present disclosure.

For reference, FIG. 7 shows that the firing data deviation value corresponding to the difference between the initial firing data (the angle of deviation and the shooting range) and the new firing data (the angle of deviation and the shooting range) may be expressed as an item of "application of a corrected amount" within the UI screen, and the firing data deviation value (corrected value applied-angle of deviation, corrected value applied-shooting range) may be defined as equation (5) below.

Corrected value applied-angle of deviation=*e*−angle of deviation of new point of impact Corrected value applied-shooting range=*f*−shooting range of new point of impact equation (5)

The deducer 24 performs a function of deducing a firing effect.

More specifically, the deducer 24 deduces the firing effect based on a distribution of impact type images of the points of impact for respective artillery weapons including new points of impact.

Figure 8:
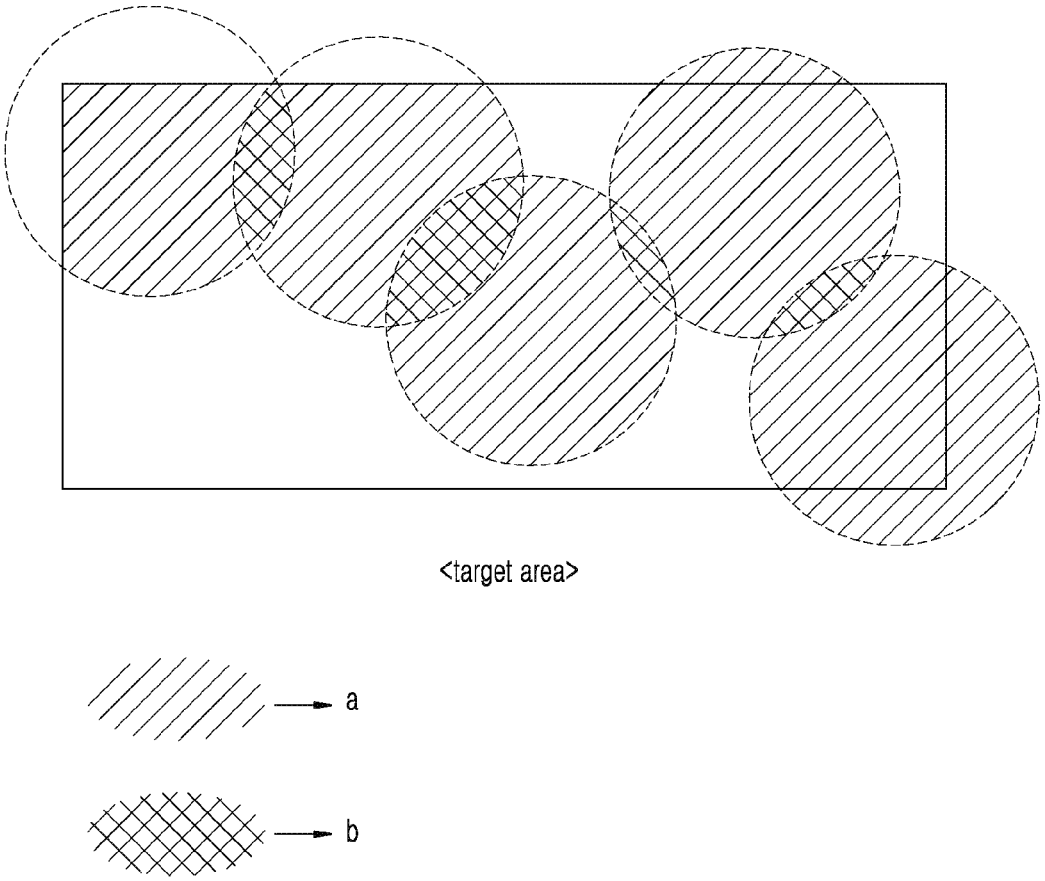
FIG. 8 illustrates a firing effect according to an embodiment of the present disclosure.

At this time, the deducer 24 deduces the firing effect based on at least one of a size (a) of areas occupied by the impact type images within the target area and a size (b) of overlapping areas between the impact type images as illustrated in FIG. 8. Here, as at least one of the size (a) of the areas occupied by the impact type images within the target area and the size (b) of the overlapping areas between the impact type images increases, a firing effect having a higher numerical value may be deduced.

Figure 9:
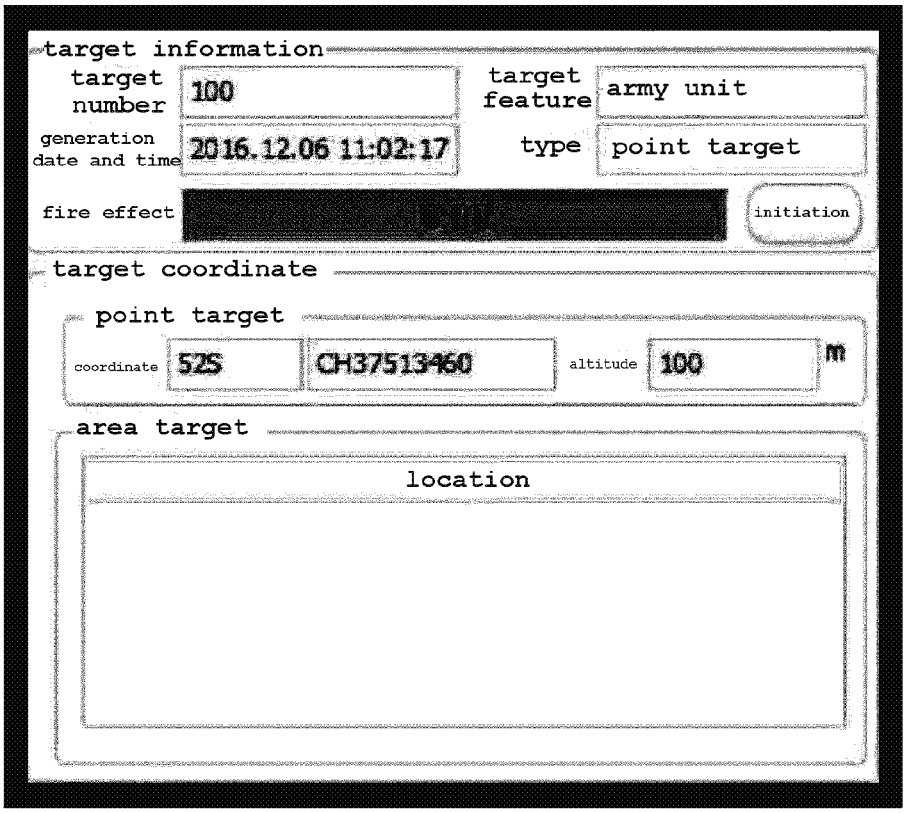
FIG. 9 illustrates a UI screen for describing a firing effect according to an embodiment of the present disclosure.

For reference, FIG. 9 shows that a firing effect deduced based on a distribution of impact type images may be displayed as numerical value information on the UI screen.

As described above, the elements of the artillery fire supporting apparatus 20 according to the embodiment of the present disclosure may support a movement of a scheduled fire point of impact for each artillery weapon displayed as a result of a scheduled fire simulation for a target area to a new point of impact which an operator desires in connection with the application of special sheaf and automatically calculate and provide new firing data (an angle of deviation and a shooting range) according to the movement of the scheduled fire point of impact, thereby effectively supporting artillery tactics.

Figure 10:
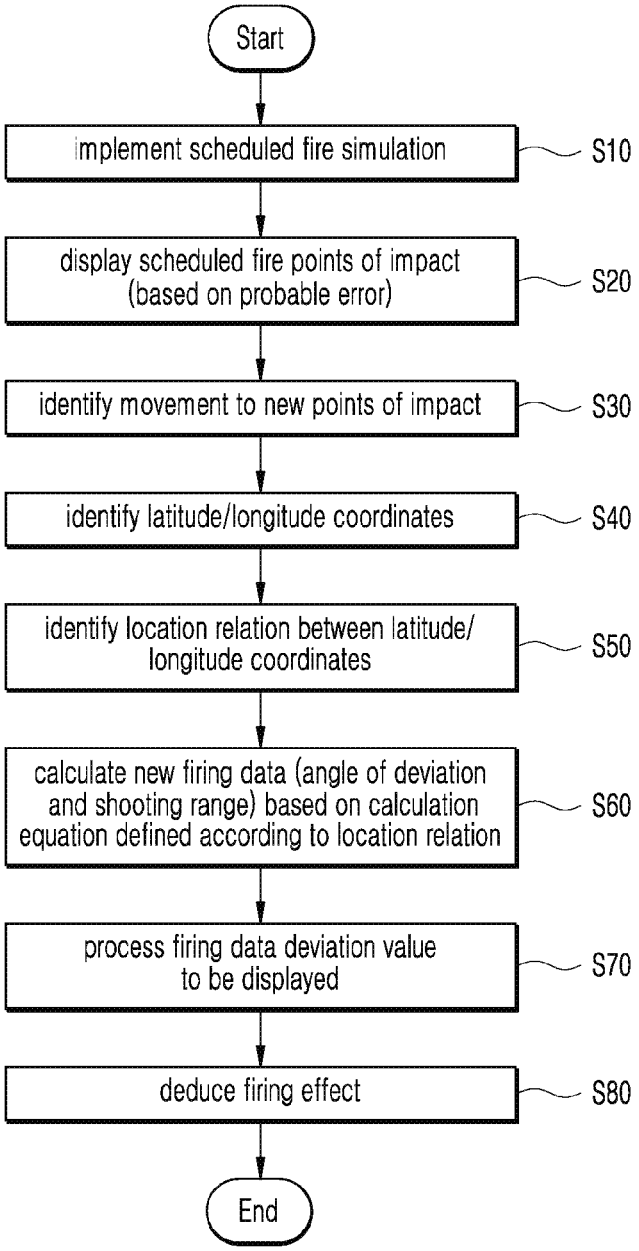
FIG. 10 is a flowchart illustrating an operation flow of an artillery fire supporting apparatus according to an embodiment of the present disclosure.

Hereinafter, an operation flow of the artillery fire supporting apparatus 20 according to the embodiment of the present disclosure will be described with reference to FIG. 10.

First, when each of a plurality of artillery weapons located in artillery positions implements a scheduled fire simulation for a target area according to initial firing data (an angle of deviation and a shooting range) in steps "S10" and "S20", the display 21 displays a scheduled fire point of impact for each artillery weapon corresponding to a result of the scheduled fire simulation on a UI screen.

At this time, the display 21 displays scheduled fire points of impact for respective artillery weapons to be distinguished from each other, and the distinguished scheduled fire points of impact for respective artillery weapons are displayed as impact type images based on a probable error probability.

Subsequently, when scheduled fire points of impact of some of the plurality of artillery weapons move to new points of impact (hereinafter, referral to as "new points of impact) by an operator's control according to the application of special sheaf for a target area in steps "S30" and "S40", the identifier 22 identifies latitude/longitude coordinates of the artillery positions where the plurality of artillery weapons are located and latitude/longitude coordinates of the new points of impact.

Here, the movement from the scheduled fire points of impact to the new points of impact may be made through, for example, a touch control or drag and drop using a control unit such as a mouse in the operator terminal 10 that displays the UI screen.

Next, when the latitude/longitude coordinate of the artillery positions and the latitude/longitude coordinate of the new point of impact are identified, the calculator 23 calculates new firing data (an angle of deviation and a shooting range) on the new point of impact by using a calculation equation based on an Earth coordinate system defined according to a location relation between the latitude/longitude coordinate of the artillery positions and the latitude/longitude coordinate of the new point of impact in steps "S50" and "S60".

Here, the location relation between the latitude/longitude coordinate of the artillery positions and the latitude/longitude coordinate of the new point of impact may include a location relation in which a difference between the latitude coordinate of the artillery positions and the latitude coordinate of the new point of impact is smaller than a threshold value, a location relation in which a difference between the longitude coordinate of the artillery positions and the longitude coordinate of the new point of impact is smaller than a threshold value, and a location relation in which both the difference between the latitude coordinate of the artillery positions and the latitude coordinate of the new point of impact and the difference between the longitude coordinate of the artillery positions and the longitude coordinate of the new point of impact are larger than the threshold values.

Further, when the calculation for the new firing data is completed, the processor 23 processes to display a firing data deviation value corresponding to a difference between the initial firing data (the angle of deviation and the shooting range) and the new firing data (the angle of deviation and the shooting range) applied to implement the scheduled firing to the scheduled fire point of impact on the UI screen in step "S70".

Thereafter, the deducer 24 deduces a firing effect based on a distribution of impact type images of the points of impact for respective artillery weapons including new points of impact in step "S80".

At this time, the deducer 24 deduces the firing effect based on at least one of a size of areas occupied by the impact type images within the target area and a size of overlapping areas between the impact type images. Here, as at least one of the size of the areas occupied by the impact type images within the target area and the size of the overlapping areas between the impact type images increases, a firing effect having a higher numerical value may be deduced.

As described above, according to an operation flow of the artillery fire supporting apparatus 20 according to the embodiment of the present disclosure, it is possible to support a movement of a scheduled fire point of impact for each artillery weapon displayed as a result of a scheduled fire simulation for a target area to a new point of impact which an operator desires in connection with the application of special sheaf and to automatically calculate and provide new firing data (an angle of deviation and a shooting range) according to the movement of the scheduled fire point of impact, thereby effectively supporting artillery tactics.

The implementations of the functional operations and subject matter described in the present disclosure may be realized by a digital electronic circuit, by the structure described in the present disclosure and the equivalent including computer software, firmware, or hardware including, or by a combination of one or more thereof. Implementations of the subject matter described in the specification may be implemented in one or more computer program products, that is, one or more modules related to a computer program command encoded on a tangible program storage medium to control an operation of a processing system or the execution by the operation.

A computer-readable medium may be a machine-readable storage device, a machine-readable storage substrate, a memory device, a composition of materials influencing a machine-readable radio wave signal, or a combination of one or more thereof.

In the specification, the term "system" or "device", for example, covers a programmable processor, a computer, or all kinds of mechanisms, devices, and machines for data processing, including a multiprocessor and a computer. The processing system may include, in addition to hardware, a code that creates an execution environment for a computer program when requested, such as a code that constitutes processor firmware, a protocol stack, a database management system, an operating system, or a combination of one or more thereof.

A computer program (also known as a program, software, software application, script, or code) can be written in any form of programming language, including compiled or interpreted languages, declarative or procedural languages, and it can be deployed in any form, including as a standalone program or module, a component, subroutine, or another unit suitable for use in a computer environment. A computer program may, but need not, correspond to a file in a file system. A program can be stored in a single file provided to the requested program, in multiple coordinated files (for example, files that store one or more modules, sub-programs, or portions of code), or in a portion of a file that holds other programs or data (for example, one or more scripts stored in a markup language document). A computer program can be deployed to be executed on one computer or on multiple computers that are located at one site or distributed across a plurality of sites and interconnected by a communication network.

A computer-readable medium suitable for storing a computer program command and data includes all types of non-volatile memories, media, and memory devices, for example, a semiconductor memory device such as an EPROM, an EEPROM, and a flash memory device, and a magnetic disk such as an external hard disk or an external disk, a magneto-optical disk, a CD-ROM, and a DVD-ROM disk. A processor and a memory may be added by a special purpose logic circuit or integrated into the logic circuit Implementations of the subject matter described in the specification may be implemented in a calculation system including a back-end component such as a data server, a middleware component such as an application server, a front-end component such as a client computer having a web browser or a graphic user interface which can interact with the implementations of the subject matter described in the specification by the user, or all combinations of one or more of the back-end, middleware, and front-end components. The components of the system can be mutually connected by any type of digital data communication such as a communication network or a medium.

While the specification contains many specific implementation details, these should not be construed as limitations on the scope of any disclosure or of what may be claimed, but rather as descriptions of features that may be specific to particular embodiments of particular disclosures. Certain features that are described in the specification in the context of separate embodiments can also be implemented in combination in a single embodiment Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

In addition, in the specification, the operations are illustrated in a specific sequence in the drawings, but it should not be understood that the operations are performed in the shown specific sequence or that all shown operations are performed in order to obtain a preferable result. In a specific case, a multitasking and parallel processing may be preferable. Furthermore, it should not be understood that a separation of the various system components of the above-mentioned implementation is required in all implementations. In addition, it should be understood that the described program components and systems usually may be integrated in a single software package or may be packaged in a multi-software product.

As described above, specific terms disclosed in the specification do not intend to limit the present disclosure. Therefore, while the present disclosure was described in detail with reference to the above-mentioned examples, a person skilled in the art may modify, change and transform some parts without departing a scope of the present disclosure. The scope of the present disclosure is defined by the appended claims to be described later, rather than the detailed description. Accordingly, it will be appreciated that all modifications or variations derived from the meaning and scope of the appended claims and their equivalents are included in the range of the present disclosure.

INDUSTRIAL APPLICABILITY

According to an artillery fire supporting apparatus and a method of operating the same according to an embodiment of the present disclosure, the present disclosure is highly applicable to the industry since the device to which the present disclosure is applied has a high probability of entering into the market and being sold, and thus the present disclosure can be obviously implemented in reality in that the present disclosure has an effect of supporting a movement of a scheduled fire point of impact for each artillery weapon displayed as a result of a scheduled fire simulation to a target area to a new point of impact which an operator desires and automatically calculating and providing new firing data according to the movement of the scheduled fire point of impact.

What is claimed is:

1. An apparatus for supporting an artillery fire, the apparatus comprising:

a display configured to display a scheduled fire point of impact for each artillery weapon corresponding to a result of a scheduled fire simulation of each of a plurality of artillery weapons located in artillery positions implemented for a target area as an impact type image based on a probable error probability;

an identifier configured to identify, when a scheduled fire point of impact of a particular artillery weapon among the plurality of artillery weapons moves to a new point of impact by an operator's control, latitude/longitude coordinates of the artillery positions and latitude/longitude coordinates of the new point of impact; and a calculator configured to calculate new firing data for placing the point of impact of the particular artillery weapon on the new point of impact according to a calculation equation based on an Earth coordinate system defined by a location relation between the latitude/longitude coordinates of the artillery positions and the latitude/longitude coordinates of the new point of impact, wherein the calculator calculates the new firing data based on equation (1) below in the location relation in which the difference between the latitude coordinate of the artillery positions and the latitude coordinate of the new point of impact is smaller than the threshold value, $$\alpha = WGS84FFEQ \times \sin(c), \qquad \text{[Equation(1)]}$$

$$\text{Shooting range}_1 = \text{RADIUS}GPI \times (d-b) \times \frac{\cos(c)}{\sqrt{1-(\alpha \times \alpha)}}, \text{ and}$$

$$\text{Angle of deviation}_1 = 90^\circ \text{ when } (d-b) > 0 \text{ and,}$$

$$\text{otherwise, } 270^\circ,$$

where, WGS84FFEQ is flatness ratio equation, c is a latitude coordinate of new point of impact, d is a longitude coordinate of new point of impact, b is a longitude coordinate of artillery positions, RADIUSGPI (Earth radius θ)=RADIUSG×Π/180, and RADIUSG=6378137.

2. The apparatus of claim 1, wherein the location relation between the latitude/longitude coordinates of the artillery positions and the latitude/longitude coordinates of the new point of impact includes at least one of a location relation in which a difference between the latitude coordinate of the artillery positions and the latitude coordinate of the new point of impact is smaller than a threshold value, a location relation in which a difference between the longitude coordinate of the artillery positions and the longitude coordinate of the new point of impact is smaller than a threshold value, and a location relation in which both the difference between the latitude coordinate of the artillery positions and the latitude coordinate of the new point of impact and the difference between the longitude coordinate of the artillery positions and the longitude coordinate of the new point of impact are larger than the threshold values.

3. The apparatus of claim 1, further comprising a processor configured to process a deviation value between initial firing data applied to implement a scheduled firing to the scheduled fire point of impact by the particular artillery weapon and the new firing data to be displayed.

4. The apparatus of claim 1, further comprising a deducer configured to deduce a firing effect having a numerical value based on a distribution of the impact type images of points of impact for respective artillery weapons including the new point of impact.

5. The apparatus of claim 4, wherein the distribution of the impact type images is determined based on at least one of a size of an area occupied by the impact type images within the target area and a size of an overlapping area between the impact type images, and, as at least one of the size of the area occupied by the impact type images within the target area and the size of the overlapping area between the impact type images increases, the firing effect having a higher numerical value is deduced.

6. A method of operating an artillery fire supporting apparatus, the method comprising:

displaying a scheduled fire point of impact for each artillery weapon corresponding to a result of a scheduled fire simulation of each of a plurality of artillery weapons located in artillery positions implemented for a target area as an impact type image based on a probable error probability;

identifying, when a scheduled fire point of impact of a particular artillery weapon among the plurality of artillery weapons moves to a new point of impact by an operator's control, latitude/longitude coordinates of the artillery positions and latitude/longitude coordinates of the new point of impact; and calculating new firing data for placing the point of impact of the particular artillery weapon on the new point of impact according to a calculation equation based on an Earth coordinate system defined by a location relation between the latitude/longitude coordinates of the artillery positions and the latitude/longitude coordinates of the new point of impact, wherein the calculating comprises calculating the new firing data based on equation (1) below in the location relation in which the difference between the latitude coordinate of the artillery positions and the latitude coordinate of the new point of impact is smaller than the threshold value, $$\alpha = WGS84FFEQ \times \sin(c), \qquad \text{[Equation(1)]}$$

$$\text{Shooting range}_1 = \text{RADIUS}GPI \times (d-b) \times \frac{\cos(c)}{\sqrt{1-(\alpha \times \alpha)}}, \text{ and}$$

$$\text{Angle of deviation}_1 = 90^\circ \text{ when } (d-b) > 0 \text{ and, otherwise, } 270^\circ,$$

where, WGS84FFEQ is flatness ratio equation, c is a latitude coordinate of new point of impact, d is a longitude coordinate of new point of impact, b is a longitude coordinate of artillery positions, RADIUSGPI (Earth radius θ)=RADIUSG×Π/180, and RADIUSG=6378137.

7. The method of claim 6, wherein the location relation between the latitude/longitude coordinates of the artillery positions and the latitude/longitude coordinates of the new point of impact includes at least one of a location relation in which a difference between the latitude coordinate of the artillery positions and the latitude coordinate of the new point of impact is smaller than a threshold value, a location relation in which a difference between the longitude coordinate of the artillery positions and the longitude coordinate of the new point of impact is smaller than a threshold value, and a location relation in which both the difference between the latitude coordinate of the artillery positions and the latitude coordinate of the new point of impact and the difference between the longitude coordinate of the artillery positions and the longitude coordinate of the new point of impact are larger than the threshold values.

8. The method of claim 6, further comprising:

processing a deviation value between initial firing data applied to implement a scheduled firing to the scheduled fire point of impact by the particular artillery weapon and the new firing data to be displayed.

9. The method of claim 6, further comprising:

deducing a firing effect having a numerical value based on a distribution of the impact type images of points of impact for respective artillery weapons including the new point of impact.

10. The method of claim 9, wherein the distribution of the impact type images is determined based on at least one of a size of an area occupied by the impact type images within the target area and a size of an overlapping area between the impact type images, and, as at least one of the size of the area occupied by the impact type images within the target area and the size of the overlapping area between the impact type images increases, the firing effect having a higher numerical value is deduced.

11. A non-transitory computer-readable recording medium storing a program of instructions for performing a method of operating an artillery fire supporting apparatus, the method comprising:

displaying a scheduled fire point of impact for each artillery weapon corresponding to a result of a scheduled fire simulation of each of a plurality of artillery weapons located in artillery positions implemented for a target area as an impact type image based on a probable error probability;

identifying, when a scheduled fire point of impact of a particular artillery weapon among the plurality of artillery weapons moves to a new point of impact by an operator's control, latitude/longitude coordinates of the artillery positions and latitude/longitude coordinates of the new point of impact; and calculating new firing data for placing the point of impact of the particular artillery weapon on the new point of impact according to a calculation equation based on an Earth coordinate system defined by a location relation between the latitude/longitude coordinates of the artillery positions and the latitude/longitude coordinates of the new point of impact, wherein the calculating comprises calculating the new firing data based on equation (1) below in the location relation in which the difference between the latitude coordinate of the artillery positions and the latitude coordinate of the new point of impact is smaller than the threshold value, $$\alpha = WGS84FFEQ \times \sin(c), \qquad \text{[Equation(1)]}$$

$$\text{Shooting range}_1 = \text{RADIUS}GPI \times (d-b) \times \frac{\cos(c)}{\sqrt{1-(\alpha \times \alpha)}}, \text{ and}$$

$$\text{Angle of deviation}_1 = 90^\circ \text{ when } (d-b) > 0 \text{ and, otherwise, } 270^\circ,$$

where, WGS84FFEQ is flatness ratio equation, c is a latitude coordinate of new point of impact, d is a longitude coordinate of new point of impact, b is a longitude coordinate of artillery positions, RADIUSGPI (Earth radius θ)=RADIUSG×Π/180, and RADIUSG=6378137.

* * * * *